US008061254B2

(12) United States Patent
Heath

(10) Patent No.: US 8,061,254 B2
(45) Date of Patent: Nov. 22, 2011

(54) FLASH SUPPRESSOR

(75) Inventor: Michael Dwayne Heath, Decatur, AL (US)

(73) Assignee: Micor Defense, Inc., Decatur, AL (US)

( * ) Notice: Subject to any disclaimer, the term of this patent is extended or adjusted under 35 U.S.C. 154(b) by 274 days.

(21) Appl. No.: 12/316,856

(22) Filed: Dec. 17, 2008

(65) Prior Publication Data

US 2010/0229713 A1 Sep. 16, 2010

(51) Int. Cl.
*F41A 21/34* (2006.01)

(52) U.S. Cl. ..... 89/14.2; 89/14.3

(58) Field of Classification Search ..... 89/14.3, 89/14.2

See application file for complete search history.

(56) References Cited

U.S. PATENT DOCUMENTS

| | | | | |
|---|---|---|---|---|
| 5,092,223 | A * | 3/1992 | Hudson | 89/14.2 |
| 5,596,161 | A * | 1/1997 | Sommers | 89/14.2 |
| 6,308,609 | B1 * | 10/2001 | Davies | 89/14.4 |
| 6,722,254 | B1 | 4/2004 | Davies | |
| 7,302,774 | B2 | 12/2007 | Meyers | |

* cited by examiner

*Primary Examiner* — Stephen M Johnson
(74) *Attorney, Agent, or Firm* — Atlanta Technology Law

(57) ABSTRACT

A flash suppressor for use with a firearm includes a generally cylindrically shaped housing having a series of horizontal groves about its exterior. An internal thread located at the proximal end of the housing is present for threadedly securing the housing to the muzzle of a firearm. There is a tapered chamber located between the internal threads and the opening which precedes the expansion chamber of the flash suppressor. The expansion chamber progressively expands being smallest at the proximal end and gradually increasing in diameter towards the distil end. Longitudinally extending, progressively helically shaped perforations are formed through the housing and in communication with the internal expansion chamber. These perforations are generally equally distributed about the housing except the bottom area which has no perforations present.

20 Claims, 4 Drawing Sheets

FLASH SUPPRESSOR

BACKGROUND OF THE INVENTION

1. Field of Invention

The present invention is directed toward flash suppressors, and more specifically, to flash suppressors having novel expansion features 2. Prior Art All U.S. patents and applications and all other published documents mentioned anywhere in this application are incorporated herein by reference in their entirety.

Without limiting the scope of the invention, a brief summary of some of the claimed embodiments of the invention is set forth below. Additional details of the summarized embodiments of the invention and/or additional embodiments of the invention may be found in the Detailed Description of the Invention below.

When a firearm is discharged an expulsion of hot, pressurized gases occurs. Contained within the gases are particles of unburnt powder. These unburnt powder particles ignite when these gases exit the muzzle of the firearm into an oxygen rich environment. The ignition of the unburnt powder particles results in flash and sound and is generally referred to as muzzle blast. A flash of light is generated in both the visible and infrared portions of the spectrum. Muzzle blast consists of combusting gases and unburnt powder particles which exit the muzzle in a rapidly expanding cone formation.

Visible flash resulting from the muzzle blast has several adverse consequences in combat. During night time operations, the sudden bright flash of visible light impairs the shooter's night vision temporarily rendering him blind. This same sudden flash of light also designates the shooter's location to enemy combatants who will then know where to direct their gun fire, indirect fire weapons and other weapons. It is also known that muzzle blast or flash can adversely affect the usability of night vision devices, many of which shut off when exposed to sudden burst of visible light. For the above reasons it is desirable to suppress the bright flash associated with muzzle blast, and a plethora of suppression devices have been devolved for this purpose, including the flash suppressors disclosed in U.S. Pat. No. 5,596,161 issued to Sommers, and U.S. Pat. No. 7,302,774 issued to Meyers.

While these referenced prior art designs along with others have achieved a measure of success, they all fall short of providing the perfect all around solution. Designs which rely on open forends are prone to becoming tangled in brush and other undergrowth encounter in combat situations. Further, having an unsupported forend creates a point of weakness that may result in a tine or prong of the flash hider either breaking off or bending in such a way as to occlude the bullets flight path should the muzzle of the weapon hit the ground or other hard surface during use. Another example is some conventional devices are not fully effective suppressors and only partially attenuate the bright flash associated with the discharge of a firearm. Therefore, a need to develop an improved flash suppressor exists.

It would be highly advantageous, therefore, to remedy the foregoing and other deficiencies inherent in the prior art.

OBJECTS AND ADVANTAGES

Accordingly several objects and advantages of the present invention are (a) To provide a flash suppressor that effectively eliminates a firearm's muzzle blast so that night vision devices may be effectively utilized with the host firearm.

(b) To provide a flash suppressor that does not rely on an open forend to function as an effective flash hider.

(c) To provide a flash suppressor which utilizes a series of flutes with a progressive twist as a means to redirect, slow and disperse gases exiting the muzzle of a discharging firearm for the purposes of reducing or eliminating muzzle flash.

(d) To provide a flash suppressor which is engineered structurally and machined from material which will resist the erosive effects of the exiting gases and provide consistent flash reduction over a prolonged firing schedule.

(e) To provide a flash suppressor which also has the ability to reduce the muzzle flip of the associated firearm.

Still further objects and advantages will become apparent from a consideration of the ensuing description and drawings.

SUMMARY

The flash suppressor of the present invention is for use with a firearm having a barrel muzzle and a bore. The flash suppressor includes a generally cylindrically shaped hollow body having a rear end which is threadedly attachable to the barrel at the muzzle of a firearm, a front end and a bottom surface. A series of groves are present about the exterior of the cylindrically shaped body. A plurality of longitudinally extending, helically shaped perforations is formed through the body. These perforations are distributed evenly about the exterior from approximately the 4 o'clock position to the 8 o'clock position. The bottom surface has no perforations. Each of the perforations ends with a gradual taper that does not perforate the body, adjacent the end wall. The hollow within the cylindrically shaped body is a frustum cone which gradually increases in diameter from the bottom of the perforations towards the front end.

In the preferred embodiment of the present invention, the plurality of helically shaped perforations each include first and second substantially parallel sidewalls defining an opening through the body with an axis which is initially inline with the bore. The helical formation of the perforations and the cone shaped hollow within the cylindrical body cause the expanding gases from a discharged firearm to expand and swirl about the interior and exterior of the herein described device thus allowing the gas to expand and cool thereby minimizing the possibility that the unburnt powder contained within the gases will combust and create a bright flash. Also present is a notch located on the bottom side of the forward end which is designed to allow for the indexing of a noise suppressor.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
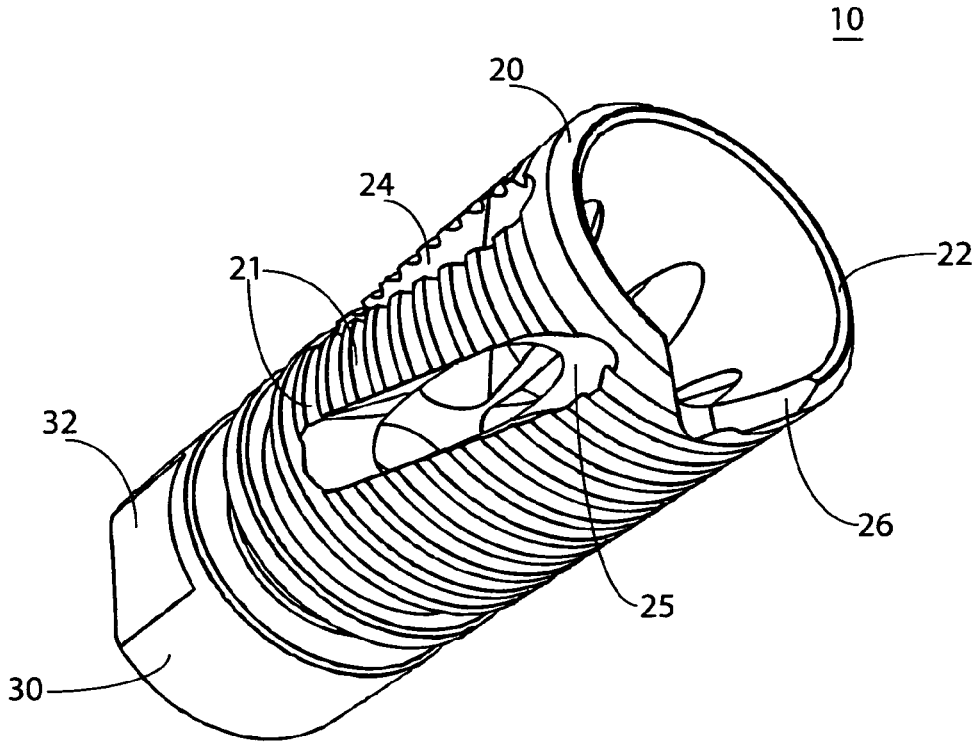
FIG. 1 is a side perspective view of my flash suppressor.
Figure 2:
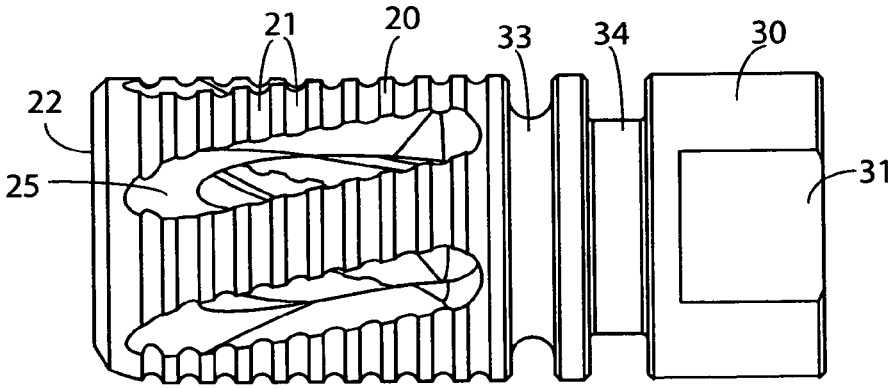
FIG. 2 is a side view thereof.
Figure 3:
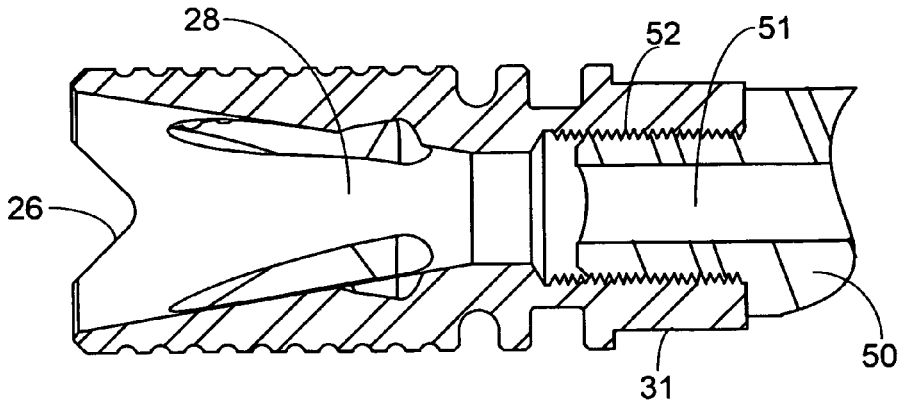
FIG. 3 is a cut away view thereof.
Figure 4:
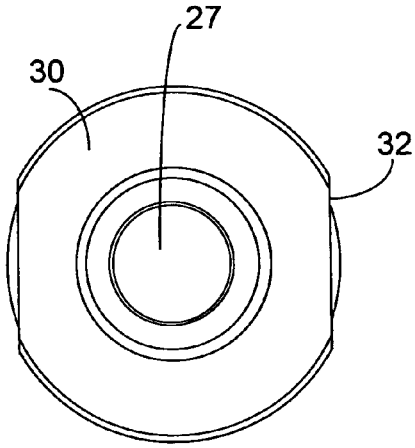
FIG. 4 is a bottom perspective view thereof.

Turning now to the drawings in which like reference characters indicate corresponding elements throughout the several views, as used herein, the word "front" or "forward" corresponds to the front end 22 of the flash suppressor 10 (i.e., to the left as shown in FIGS. 1, 2, 3); "rear" or "rearward" or "back" corresponds to the direction opposite the front end 22 of the flash suppressor 10 (i.e., to the right as shown in FIGS. 1, 2, 3).

Attention is first directed to FIGS. 1, 2 and 3, which show the preferred embodiment of the present invention. It depicts a flash suppressor 10 configured for use with the M16 family of weaponry. Such firearms have a barrel 50 with a conventional male threaded extension 52. Flash suppressor 10 generally includes cylindrical shaped housing 20 which has a threaded recess 31 adjacent the rear end 30 for receiving the extension 52 of the gun barrel 50. Pair of wrench flats 32 is located about the exterior of the rear end 30 of the flash suppressor 10. A series of grooves 21 are present about the exterior of the cylindrical housing 20 and help dissipate heat build up and reduce the weight of the flash suppressor. The bottom surface 23 of the cylindrical housing 20 has no perforations and aids the flash suppressor is reducing the muzzle climb of the attached firearm. The flash suppressor 10 is made of 17-4 stainless with surface hardening and a black protective finish. Other material such as 4140, and finish such as black oxide would be acceptable for general use Cylindrical shaped housing 20 includes a thru bore 27 of diameter slightly larger than the bore of the firearm to which the flash suppressor 10 is attached. The thru bore 27 connects to cone shaped hollow 28 which gradually increases in diameter having a diameter roughly 0.576" larger than that of thru bore 27. The diameter of the cone shaped hollow 28 is large enough so that the exiting projectile will not touch any portion of the device as it proceeds. The body of the flash suppressor 10 surrounding the cone shaped hollow 28 has five spaced helical shaped perforations 24 running the length of cone shaped hollow 28. Perforations 24 have tapered distil ends 25, the taper is preferably between 20° and 30°. The helical perforations 24 are spaced proximate between the eight o'clock and four o'clock position of the flash suppressor. As may be seen on FIG. 5, the centerline 29 of the perforations 24 are not offset 27 from the thru bore 27 of the cylindrically shaped housing 20.

In the 5.56 mm caliber embodiment, perforations 24 are approximately 0.196" wide and approximately 0.984" long. Trial and error has shown that a housing 20 which has a cone shaped hollow 28 in combination with a series of helical perforations 24 provides optimal muzzle flash reduction and durability of the flash suppressor 10.

Figure 5:
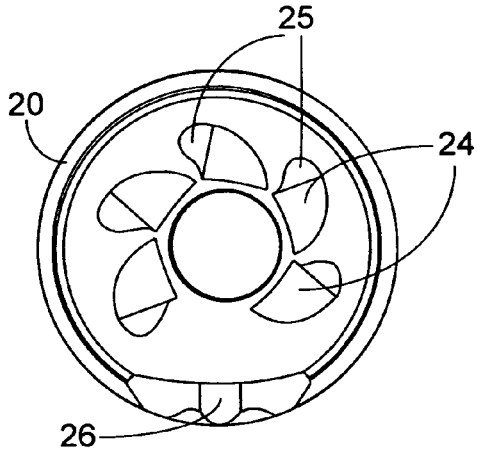
FIG. 5 is a front view of the flash suppressor.
Figure 6:
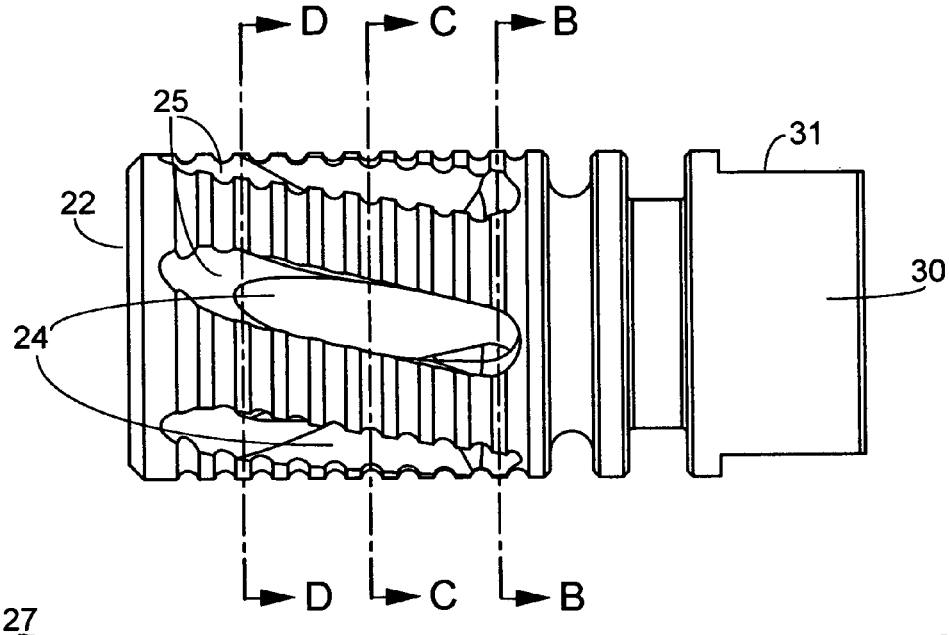
FIG. 6 is a side perspective view of the herein described device rotated 45 degrees from the view illustrated in FIG. 2.
Figure 7:
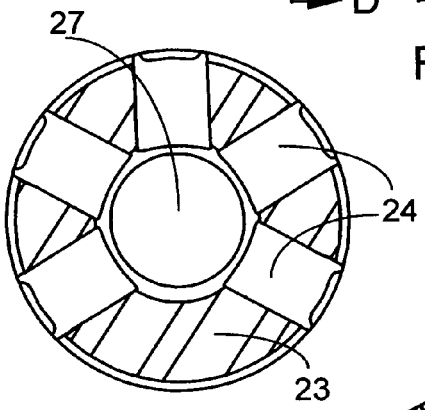
FIG. 7 is a cross section view taken along line B-B.
Figure 9:
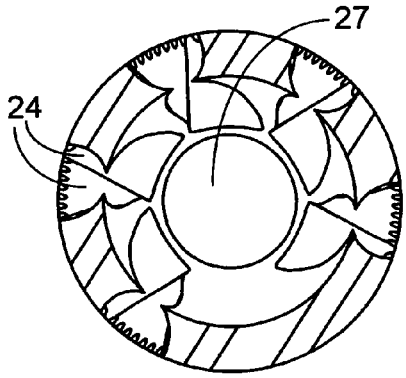
FIG. 9 is a cross section view taken along line D-D.
Figure 8:
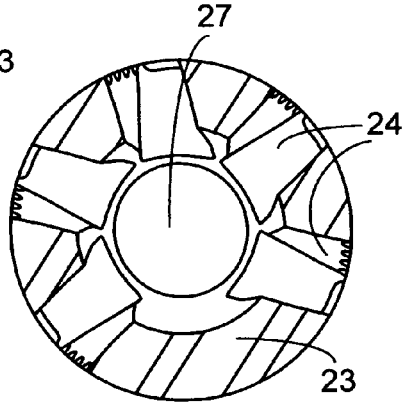
FIG. 8 is a cross section view taken along line C-C.
Figure 10:
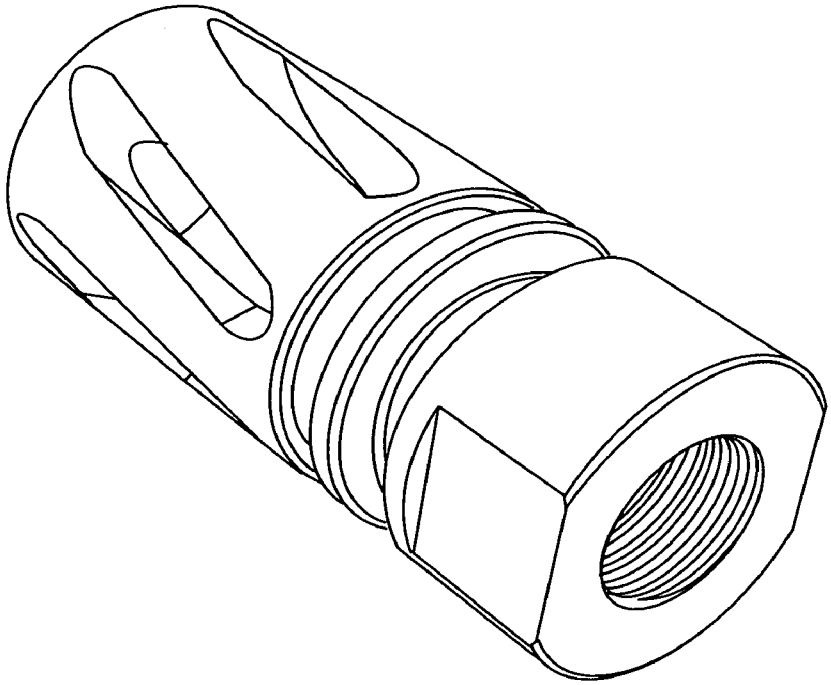
FIG. 10 is a side perspective view of an alternate embodiment of the herein described device.
Figure 11:
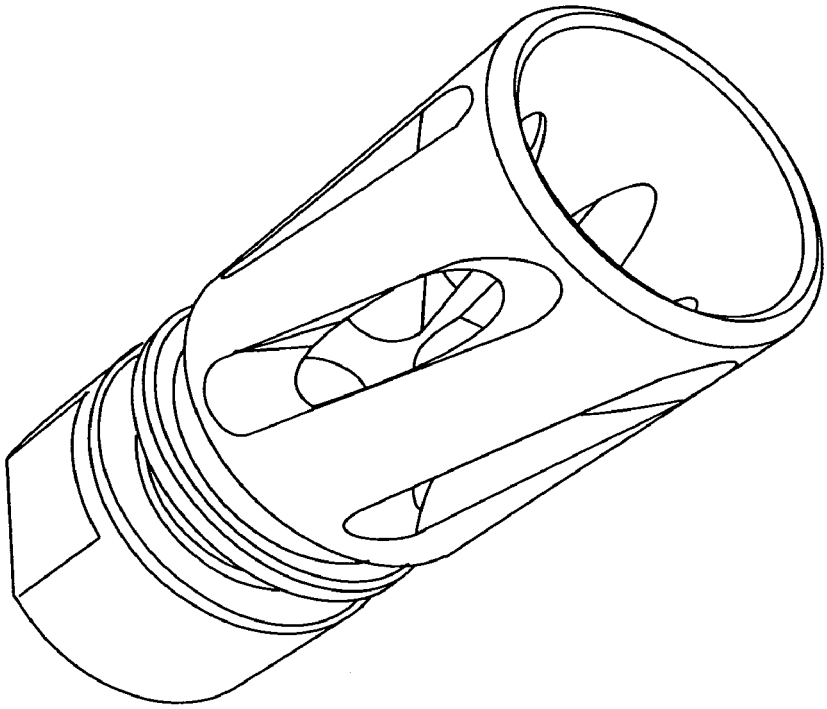
FIG. 11 is an alternate view thereof.

The military embodiment also includes a radial attachment ring 33 for securing a blank firing device (not shown) during training. Also, another radial attachment ring 34 is provided along with a generally V shaped notch 26, as shown in FIGS. 1,3 and 5, in the front end 22 which is used to secure a noise suppressor (not shown but well known in the art).

In operation, the flash suppressor is simply screwed onto the end of the barrel extension until it stops. When a firearm from the M16 family of weapons is fired, the exiting spinning bullet proceeds through the thru bore 27 and through cone shaped hollow 28. The spinning shock wave ahead of the bullet moves forward and outward, drawing the air in the cone shaped hollow with it. Propellant gas does not immediately ignite in the evacuated exit hollow due to a lack of oxygen, and then is expelled forward and outward through the provided helical perforations, cooling and dispersing the gas before it combines with enough oxygen to ignite. Drawing the gas outward also decreases friction on the spinning bullet making the bullet's trajectory more stable, and it decreases the reactive torque exerted by the spinning gas on the barrel. Also, the exiting gases strike the closed bottom surface of the flash suppressor and exits out of the provided opening thereby resisting the upward climb or muzzle flip of the flash suppressor and host firearm combination.

CONCLUSION, RAMIFICATIONS, AND SCOPE

Accordingly the reader will see that I have provided a flash suppressor which offers several advancements over the prior art. The herein disclosed device affords the user improved flash reduction over many of the available flash hider designs without increasing the overall length of the weapon. Weight reduction and improved heat dissipation are achieved by adding a plurality of groves about the exterior surface. Flash reduction is improved by the combination of a cone shaped hollow and a plurality of helical perforations.

Further, my design reduces muzzle flip by causing the expanding propellant gases to push against the solid bottom surface provided. For military, some law enforcement and civilian users the option of attaching a noise suppressor and a blank firing device have been provided for.

Another embodiment of the flash suppressor could omit the black firing and/or silencer attachment points and have the external grooves omitted without departing from the spirit of the herein claimed device.

While my above drawings and description contain much specificity, these should not be construed as limitations on the scope of the invention, but rather as an exemplification of one preferred embodiment thereof.

Accordingly, the scope of the invention should be determined not by the embodiments illustrated, but by the appended claims and their legal equivalents.

What is claimed is:

1. A flash suppressor for use with a firearm comprising:

a cylindrically shaped hollow body having an inside surface, an outside surface, a rear end configured to threadable attach to the exterior muzzle of a firearm, and a forward end generally opposite the rear end, the hollow within the cylindrical body is generally conical in shape with a thru bore extending along the longitudinal axis from the rear end to the forward end of sufficient diameter to allow a projectile to pass thru;

a plurality of longitudinally extending, helically shaped perforations thru the body extending to the thru bore, the helically shaped perforations have an end adjacent to the forward end of the body with a gradual taper from the inside of the hollow body to the outside surface of the body; and, the helically shaped perforations are distributed around the longitudinal axis of the body.

2. A flash suppressor as claimed in claim 1 wherein:

the gradual taper of the plurality of helically shaped perforations approximate the forward end is angled generally toward the forward end of the body with an angle in the range of approximately 20 degrees to 30 degrees.

3. A flash suppressor as claimed in claim 1 wherein:
the plurality of longitudinally extending helically shaped perforations are symmetrically distributed around the axis of the body.

4. A flash suppressor as claimed in claim 3 wherein:
the plurality of longitudinally extending helically shaped perforations number between two and five.

5. A flash suppressor as claimed in claim 1 wherein:
the helically shaped perforations do not intersect the forward end of the body.

6. A flash suppressor as claimed in claim 1 wherein:
the cylindrically shaped body has a notch in the bottom surface of the forward end.

7. A flash suppressor as claimed in claim 1 wherein:
the plurality of longitudinally extending, helically shaped perforations are disposed to redirect escaping gases in a helical pattern about the body.

8. A flash suppressor comprising:
a cylindrically shaped body having a rear end, a bottom side, and a forward end, and an internal cone shaped chamber extending axially from the rear end to the forward end,
the internal chamber has an opening proximate the rear end which has a smaller diameter than the diameter of the opening at the front end, the diameter of the internal chamber gradually increases in diameter from the rear end to the front end, and
a plurality of longitudinally extending, helically shaped perforations thru the body in communication with the internal chamber, the helically shaped perforations have an end adjacent to the forward end of the body with a gradual taper from the inside of the hollow body to the outside surface of the body.

9. A flash suppressor as provided for in claim 8 wherein:
the gradual taper of the plurality of helically shaped perforations approximate the forward end is angled generally toward the forward end of the body with an angle in the range of approximately 20 degrees to 30 degrees.

10. A flash suppressor as claimed in claim 8 wherein:
the plurality of longitudinally extending helically shaped perforations are symmetrically distributed around the axis of the body.

11. A flash suppressor as claimed in claim 8 wherein:
the plurality of longitudinally extending helically shaped perforations number between two and five.

12. A flash suppressor as claimed in claim 8 wherein:
the helically shaped perforations do not intersect the forward end of the body.

13. A flash suppressor as claimed in claim 8 wherein:
a notch in the bottom side of the forward end of the body.

14. A flash suppressor for use with a firearm comprising:
a cylindrically shaped body having a rear end configured to threadable attach to the exterior muzzle of a firearm, a bottom side, and a forward end that defines a solid diameter, and an internal cone shaped chamber extending axially from the rear end to the forward end,
the internal chamber has an opening proximate the rear end which has a diameter of sufficient size to allow a bullet from the firearm to pass thru unobstructed, the diameter of the internal chamber gradually increases in diameter from the rear end to the front end, and
a plurality of longitudinally extending, helically shaped perforations thru the body connecting with the internal chamber, the helically shaped perforations have an end proximate to the forward end of the body with a gradual taper from the inside of the hollow body to the outside surface of the body through which gasses from the firearm are vented.

15. A flash suppressor as provided for in claim 14 wherein:
the gradual taper of the plurality of helically shaped perforations approximate the forward end is angled generally toward the forward end of the body with an angle in the range of approximately 20 degrees to 30 degrees.

16. A flash suppressor as provided for in claim 15 wherein:
the gradual taper of the plurality of helically shaped perforations approximate the forward end is angled generally toward the forward end of the body with an angle in the range of approximately 25 degrees.

17. A flash suppressor as claimed in claim 14 wherein:
the plurality of longitudinally extending helically shaped perforations are symmetrically distributed around the axis of the body.

18. A flash suppressor as claimed in claim 14 wherein:
the plurality of longitudinally extending helically shaped perforations number between two and five.

19. A flash suppressor as claimed in claim 14 wherein:
the helically shaped perforations do not intersect the forward end of the body.

20. A flash suppressor as claimed in claim 14 wherein:
the cylindrically shaped body has a substantially V-shaped notch on the bottom side of the forward end.

* * * * *